United States Patent [19]

Grace

[11] 4,173,935

[45] Nov. 13, 1979

[54] DUMP SCOW

[76] Inventor: Frederick J. Grace, P.O. Box 516, Chambers Bridge Rd., Bricktown, N.J. 08723

[21] Appl. No.: 867,720

[22] Filed: Jan. 9, 1978

[51] Int. Cl.[2] ..... B63B 35/30

[52] U.S. Cl. ..... 114/36; 414/137

[58] Field of Search ..... 114/26–30, 114/36, 37, 72, 73; 214/13, 12, 15 R; 105/262, 263, 254

[56] References Cited

U.S. PATENT DOCUMENTS

| | | | |
|---|---|---|---|
| 253,585 | 2/1882 | Collin | 105/254 |
| 606,289 | 6/1898 | Lays | 114/37 |
| 3,606,036 | 9/1971 | Beebe et al. | 114/72 X |

*Primary Examiner*—Trygve M. Blix
*Assistant Examiner*—Sherman D. Basinger
*Attorney, Agent, or Firm*—Hauke and Patalidis

[57] ABSTRACT

A barge or scow for transferring refuse from a collection site to a disposal site has an elongated open hold or cavity with a flat bottom sloping downward from a shallow end of the cavity to a deep end where a cargo-discharge gate is located. A number of spaced water-feed nozzles positioned at the shallow end of the cavity are used to direct water at the sides and bottom of the cavity in order to wash through the discharge gate any refuse which has stuck to the sides and bottom of the cavity during a cargo-discharge operation.

3 Claims, 3 Drawing Figures

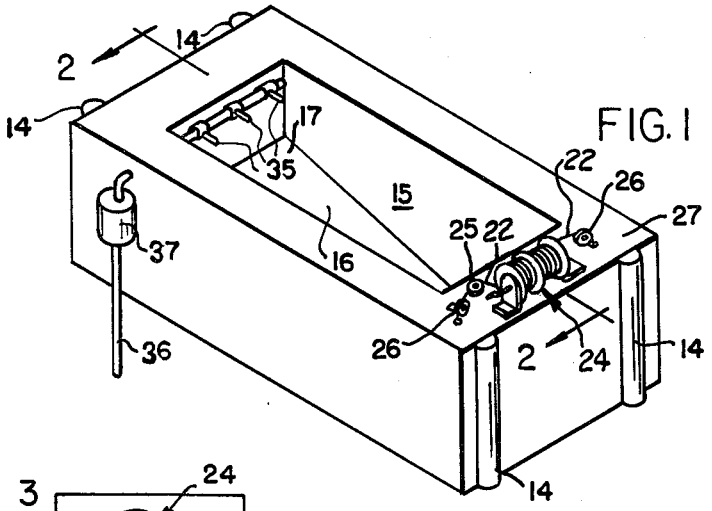
FIG. 1
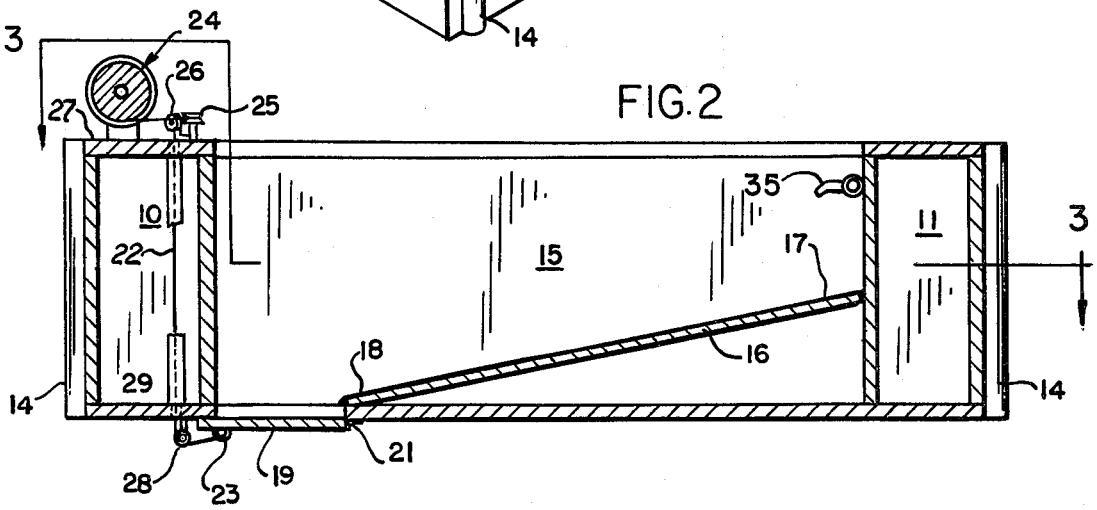
FIG. 2
FIG. 3
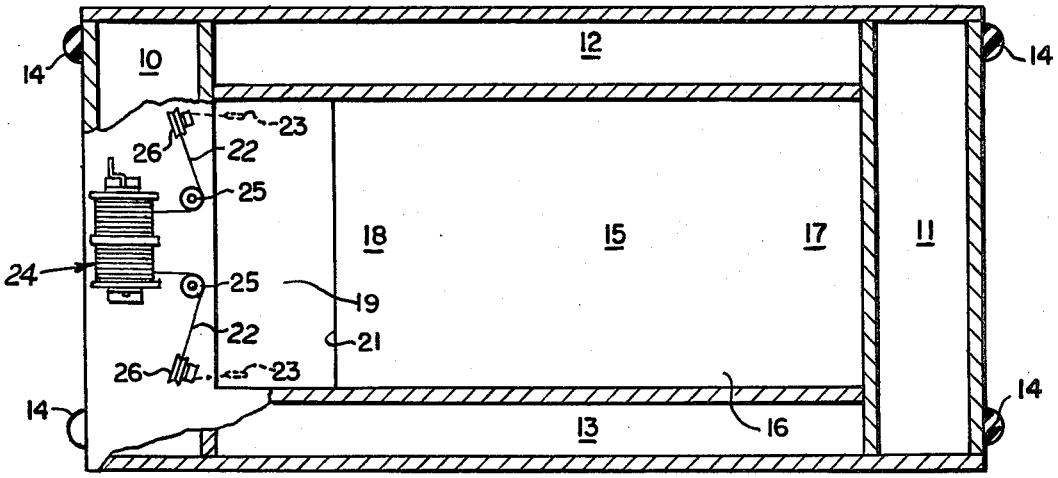

DUMP SCOW

BACKGROUND OF THE PRESENT INVENTION

Dump scows are barges designed specifically to remove material, such as spoil or refuse, from a collection site to an underwater disposal area or dump site. In general, such scows have flotation compartments along the sides and ends and one or more open hoppers or holds serving as cargo cavities. The sides of these cargo cavities slope steeply downward toward the center of the scow where cargo-discharge gates are located. Thus, when the discharge gates are open the cargo is discharged from the scow through the bottom of each hopper.

Conventionally, dump scows have their hoppers or cargo cavities positioned to provide a load distribution which will maintain the scows on even keels whether they are loaded or empty. This tends to limit scow designs to barges in which a plurality of hoppers have discharge gates spaced along the keel of the barge. In a few cases, double rows of hoppers have discharge gates in alignment on each side of the keel. However, this construction can result in a serious listing of the barge in the event several hoppers on the same side of the barge fail to discharge in unison with the others.

SUMMARY

The present invention is directed to a dump scow in which an elongated cargo-carrying cavity has a flat bottom sloping downwardly from a shallow end of the cavity to a deep end. A cargo-disharge gate is positioned at the deep end of the cavity and a number of water-feed nozzles are positioned at the shallow end of the cavity and aimed to sweep through the discharge gate any material which has stuck within the cavity during a cargo-discharge operation.

BRIEF DESCRIPTION OF THE DRAWING

FIG. 1 of the drawing is a perspective view of a dump scow made in accordance with the present invention;

FIG. 2 is a view partially in section taken along the lines 2—2 of FIG. 1; and

FIG. 3 is a view partially in section taken along the lines 3—3 of FIG. 2.

DESCRIPTION OF THE PREFERRED EMBODIMENT

Dump scows in accordance with this invention are usually constructed of wood or metal such as steel plate. As best shown in FIG. 3, the sides and ends of the hull are aligned with airtight flotation compartments as indicated at 10, 11, 12 and 13. The outside ends of the scow are protected by a plurality of bumpers or fenders 14 in order to prevent abrasion or rupture of the scow during loading and towing operations.

The scow has an open hold or cargo cavity 15 having a bottom 16 which slopes in a downward direction from a shallow end 17 to a deep end 18. As best shown in FIG. 2, the slope angle of the bottom 16 is about 15°. This angle can vary according to the type of material the scow is designed to carry.

The deep end 18 of the scow is equipped with a cargo-discharge gate 19 mounted on a hinge 21 which enables the gate 19 to swing downward to a vertical position during the unloading of the scow. The gate 19 is held in closed position by means of a pair of cables 22 each having an end attached to the gate 19 by means of a fastening ring 23. The other end of each cable 22 is wrapped around a windlass 24. Each cable 22 winds around one of a pair of sheaves or pulleys 25 and 26 mounted on the scow deck 27 on both sides of the windlass 24 and a sheave or pulley 28 mounted below the scow hull, after passing through appropriate apertures through the deck and the bottom of the hull. A pipe 29 surrounding the cable, prevents water from being introduced into the compartment 10. When the pawl (not shown) of the windlass 24 is released, the gate 19 swings downwardly into an open position.

At the shallow end 17 of the cavity 15 a plurality of water-feed nozzles 35 are positioned. Water is fed at high velocity to the nozzles 35 by means of a pipe 36 and a pump 37. The pump 37 is not shown in detail as it may be a conventional centrifugal pump driven by an electric motor or an internal combustion engine.

The dump scow of the present invention can have a single cargo hold as illustrated in the drawing. Although there is no limitation on the number of such holds that may be present on a single scow, it is to be noted that in the case of a single hold, the load center of the cargo will have the effect of tipping the scow in the direction of the deep end 18. This may be compensated for by making the flotation compartment 10 larger than the compartment 11 or by sloping the sides of the compartments 12 and 13 to provide greater flotation at the deep end 18. It is to be noted, however, that the angle of the sloping bottom 16 of the cargo cavity 15 is not so great as to bring about a great shift in the center of loading of the cargo to the deep end 18. If no additional flotation is provided at the deep end 18, the results will be that when carrying cargo the scow will be slightly lower in the water at the deep end. This is an advantage during the unloading operation as the angle between the sloping bottom 16 and water surface is increased slightly and this in turn increases the rate of discharge of cargo when the gate 19 is opened. As the discharge operation proceeds the loss of weight of the cargo at the deep end results in the scow assuming a more even keel. As a result some of the cargo can stick to the sides of the cavity 15 and particularly to the bottom 16 of the cavity.

After most of the cargo has been discharged through the gate 19 by gravity action the residual cargo remaining in the cavity 15 is discharged by starting the pump 37. The nozzles 35 are aimed to wash down the portions of the cavity 15 where cargo residues are most apt to gather. Accordingly, the starting of the pump 37 produces wash water through the nozzles 35 to bring about quick cleaning of the cavity 15 of all cargo residues. The windlass 24 is then actuated to close the gate 19 and the scow is ready to return for another load.

The combination of a cargo hold or cavity 15 having a mildly sloping bottom 16 with water-feed nozzles 35 produces a dump scow having a large cargo hold in which the load center is displaced slightly from the scow center. It is obvious that there may be many variations in scow construction which properly fall within the scope of this invention. Accordingly, the invention should be limited in its scope only as may be necessitated by the scope of the appended claims.

I claim:

1. A dump scow comprising a hull having a single cargo carrying cavity, floatation compartments disposed in said hull surrounding said cargo carrying cavity, a single discharge opening in the bottom of said hull at one end of said cargo carrying cavity, said cargo carrying cavity having a bottom surface downwardly sloping from the other end of said cargo carrying cavity to said cargo discharge opening, a gate having a hinge, said gate normally closing said cargo discharge opening, means for controllably closing said gate and for controllably opening said gate for unloading material contained in said cargo carrying cavity through said discharge opening, and water-fed nozzles for introducing wash water into said cargo cavity from the other end of said cargo carrying cavity, for washing down said opening any of said material remaining in said cargo carrying cavity.

2. The dump scow of claim 1 wherein said means for opening and closing said gate comprises a windlass, at least one cable windable around said windlass, said cable being passed through a pipe disposed vertically in one of said floatation compartments, the end of said cable projecting through the bottom of said floatation compartment being attached to said gate proximate an edge thereof opposite to said hinge.

3. The dump scow of claim 1 wherein said bottom surface of said cargo carrying cavity is sloping at an angle of about 15°.

* * * * *